US005327110A

United States Patent [19]

Block

[11] Patent Number: 5,327,110

[45] Date of Patent: Jul. 5, 1994

[54] CERAMIC COAXIAL RESONATOR

[75] Inventor: Christian Block, Graz, Austria

[73] Assignee: Siemens Matsushita Comp. GmbH & Co. KG, Munich, Fed. Rep. of Germany

[21] Appl. No.: 115,935

[22] Filed: Sep. 1, 1993

[30] Foreign Application Priority Data

Sep. 1, 1992 [DE] Fed. Rep. of Germany ..... 4229165

[51] Int. Cl.[5] ..... H01P 7/04

[52] U.S. Cl. ..... 333/222; 333/219.1

[58] Field of Search ..... 333/202, 203, 206, 207, 333/222-226, 219, 219.1

[56] References Cited

U.S. PATENT DOCUMENTS 4,937,542 6/1990 Nakatuka ..... 333/222 X

FOREIGN PATENT DOCUMENTS 62-43904 2/1987 Japan .
2241203 9/1990 Japan .

*Primary Examiner*—Seungsook Ham

*Attorney, Agent, or Firm*—Herbert L. Lerner; Laurence A. Greenberg

[57] ABSTRACT

A coaxial resonator includes a ceramic body having outer surfaces including an end surface forming a connecting side. The ceramic body has a through hole extending longitudinally through the ceramic body defining an inner surface in the through hole. The end surface has an indentation formed therein surrounding the through hole. Metallizing is disposed on the inner surface and on all of the outer surfaces including the indentation except for the end surface. The metallized outer surfaces form an external conductor and the metallized inner surface forms an internal conductor. The ceramic body has notches extending inwardly from one of the outer surfaces in the vicinity of the indentation for galvanic separation of the internal conductor metallizing of the through hole and the indentation from the external conductor metallizing. The notches separate out a surface portion from the outer surface forming a connection for the internal conductor through the metallizing of the indentation.

2 Claims, 1 Drawing Sheet

CERAMIC COAXIAL RESONATOR

BACKGROUND OF THE INVENTION

Field of the Invention

The present invention relates to a coaxial resonator including a ceramic body with a through hole extending longitudinally of the body and with metallizing on all sides, except for an end surface forming a connecting side, wherein the metallized outer surfaces of the ceramic body form an external conductor and the metallized through hole forms an internal conductor.

A coaxial resonator of the generic type described above is formed by a ceramic body, in particular with a cuboid shape, which has a continuous through hole extending in its longitudinal direction. Except for its end surface, at which the through hole emerges on one side, the ceramic body is metallized on all sides, including the inner surface of the through hole. The metallizing through hole forms the internal conductor of the resonator, while the metallized outer surface of the body forms the external conductor.

In order to bond the internal conductor, a solder tag is often introduced into the through hole of the ceramic body and soldered by using a solder with a high melting point. However, positioning and soldering the connection solder tab involves major expense in producing the component. Customer demands for coplanarity for the solder points, on the order of 0.1 mm for an SMD assembly, dictate a further increase in the production cost.

SUMMARY OF THE INVENTION

It is accordingly an object of the invention to provide a ceramic coaxial resonator, which overcomes the hereinaforementioned disadvantages of the heretofore-known devices of this general type and which assures a lower production cost.

With the foregoing and other objects in view there is provided, in accordance with the invention, a coaxial resonator, comprising a ceramic body having outer surfaces including an end surface forming a connecting side, the ceramic body having a through hole extending longitudinally through the ceramic body defining an inner surface in the through hole, and the end surface having an indentation formed therein surrounding the through hole; metallizing disposed on the inner surface and on all of the outer surfaces including the indentation except for the end surface, the metallized outer surfaces forming an external conductor and the metallized inner surface forming an internal conductor; and the ceramic body having notches extending inwardly from one of the outer surfaces in the vicinity of the indentation for galvanic separation of the internal conductor metallizing of the through hole and the indentation from the external conductor metallizing, the notches separating out a surface portion from the outer surface forming a connection for the internal conductor through the metallizing of the indentation.

In accordance with a concomitant feature of the invention, the metallizing is formed of copper.

Other features which are considered as characteristic for the invention are set forth in the appended claims.

Although the invention is illustrated and described herein as embodied in a ceramic coaxial resonator, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
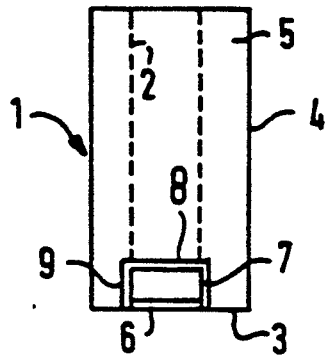
FIG. 1 is a diagrammatic, bottom plan view of a coaxial resonator according to the invention.
Figure 2:
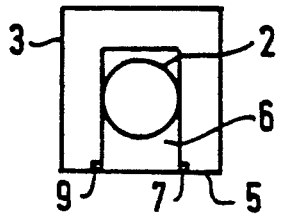
FIG. 2 is a side-elevational view of the coaxial resonator of FIG. 1.
Figure 3:
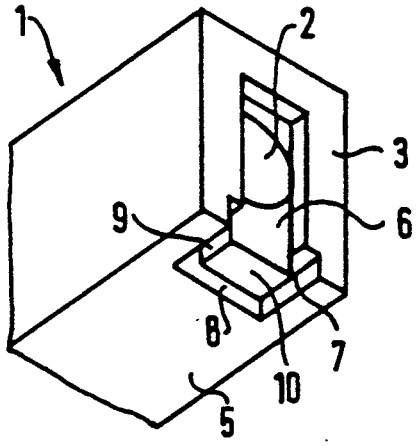
FIG. 3 is a fragmentary, perspective view of the coaxial resonator of FIG. 1.

Referring now in detail to FIGS. 1-3 of the drawing, there is seen a coaxial resonator according to the invention which is formed by a ceramic body 1 with a through hole 2 extending longitudinally of the body. This ceramic body 1, including an inner surface defined by the through hole 2, is metallized on all sides except for an end surface 3. The metallized internal through hole 2 then forms an internal conductor of the coaxial resonator, while the metallized outer surface of the ceramic body forms an external conductor. In the view of FIG. 1, two of the outer surfaces of the ceramic body 1 are shown and marked with reference numerals 4 and 5. For the sake of simplicity, the metallizing is not separately shown in FIGS. 1-3.

In order to bond the metallized through hole 2 forming the internal conductor, an indentation 6 is provided in the end surface 3. The surfaces of this indentation 6 are likewise metallized, while the end surface 3 is free of metallizing.

In order to galvanically separate the internal and external conductors, notches 7, 8 and 9 extending inwardly from the outer surface 5 are provided in the region of the indentation 6. In the outer surface 5, the notches 7, 8 and 9 separate out a surface portion or part 10, which through the metallizing of the indentation 6 forms a connection for the internal conductor formed by the metallized through hole 2. The galvanic separation of the internal and external conductors that is provided by the notches 7, 8 and 9, may be effected by means of a cutting saw, for instance.

Bonding the internal conductor in accordance with the invention gains the advantage of eliminating the expense for soldering a connecting solder lug. Moreover, if the metallizing of the coaxial resonator is formed by copper, then its solder resistance is increased when soldered into a circuit to form an SMD component. Omitting a connecting solder lug also makes the component shorter, so that the customer saves space in a circuit. Finally, the coplanarity which is essential for soldering the component into the housing is determined only by a production-dictated slight curvature of the ceramic body 1, which is less than 0.05 mm.

I claim:

1. A coaxial resonator, comprising:

a ceramic body having outer surfaces including an end surface forming a connecting side, said ceramic body having a through hole extending longitudinally through said ceramic body defining an inner surface in said through hole, and said end surface having an indentation formed therein surrounding said through hole, metallizing disposed on said inner surface and on all of said outer surfaces including said indentation except for said end surface, said metallized outer surfaces forming an external conductor and said metallized inner surface forming an internal conductor, and said ceramic body having notches extending inwardly from one of said outer surfaces in the vicinity of said indentation for galvanic separation of said internal conductor metallizing of said through hole and said indentation from said external conductor metallizing, said notches separating out a surface portion from said one outer surface forming a connection for said internal conductor through said metallizing of said indentation.

2. The coaxial resonator according to claim 1, wherein said metallizing is formed of copper.

* * * * *